US006031185A

United States Patent [19]

Bouveret et al.

[11] Patent Number: 6,031,185

[45] Date of Patent: Feb. 29, 2000

[54] METHOD AND A DEVICE FOR GROUNDING THE SHIELDING BRAIDS OF SHIELDED CABLES

[75] Inventors: Jean-Claude Bouveret, Villeurbanne; Jean Sabatier, Vaulx En Velin, both of France

[73] Assignee: GEC Alsthom Transport Sa, Paris, France

[21] Appl. No.: 09/025,261

[22] Filed: Feb. 18, 1998

[30] Foreign Application Priority Data

Feb. 20, 1997 [FR] France ..... 97 02008

[51] Int. Cl.[7] ..... H01R 4/00

[52] U.S. Cl. ..... 174/84 R; 174/88 R; 439/98; 439/99

[58] Field of Search ..... 174/78, 79, 35 R, 174/35 C, 36, 84 R, 102 A, 88 R; 439/98, 99

[56] References Cited

U.S. PATENT DOCUMENTS

| | | | |
|---|---|---|---|
| 4,201,433 | 5/1980 | Caldwell | 339/14 L |
| 4,613,191 | 9/1986 | Papa | 339/14 R |
| 4,653,840 | 3/1987 | Grabbe et al. | 339/177 R |
| 4,828,512 | 5/1989 | McCormick et al. | 439/495 |
| 5,281,762 | 1/1994 | Long et al. | 174/78 |

OTHER PUBLICATIONS

Patent Abstracts of Japan, vol. 018, No. 155 (E–1524) Mar. 15, 1994 corresponding to JP 05 328573 A (Mitsubishi Electric Corp), Dec. 10, 1993.

Patent Abstracts of Japan, vol. 017, No. 295 (E–1377), Jun. 7, 1993 corresponding to JP 05 021968 A (Fujitsu Ltd), dated Jan. 29, 1993.

*Primary Examiner*—Kristine Kincaid
*Assistant Examiner*—William H Mayo, III
*Attorney, Agent, or Firm*—Sughrue, Mion, Zinn, Macpeak & Seas, PLLC

[57] ABSTRACT

The present invention relates to a method and a device for grounding shielding braids of shielded cables. The device includes a longitudinal support of generally channel-shaped cross section, with a gasket covered in a sheath disposed in the bottom thereof. The support is suitable for receiving a cover on the top face thereof, the support including, in the upper portion thereof, a series of holes suitable for receiving the shielded cables.

8 Claims, 1 Drawing Sheet

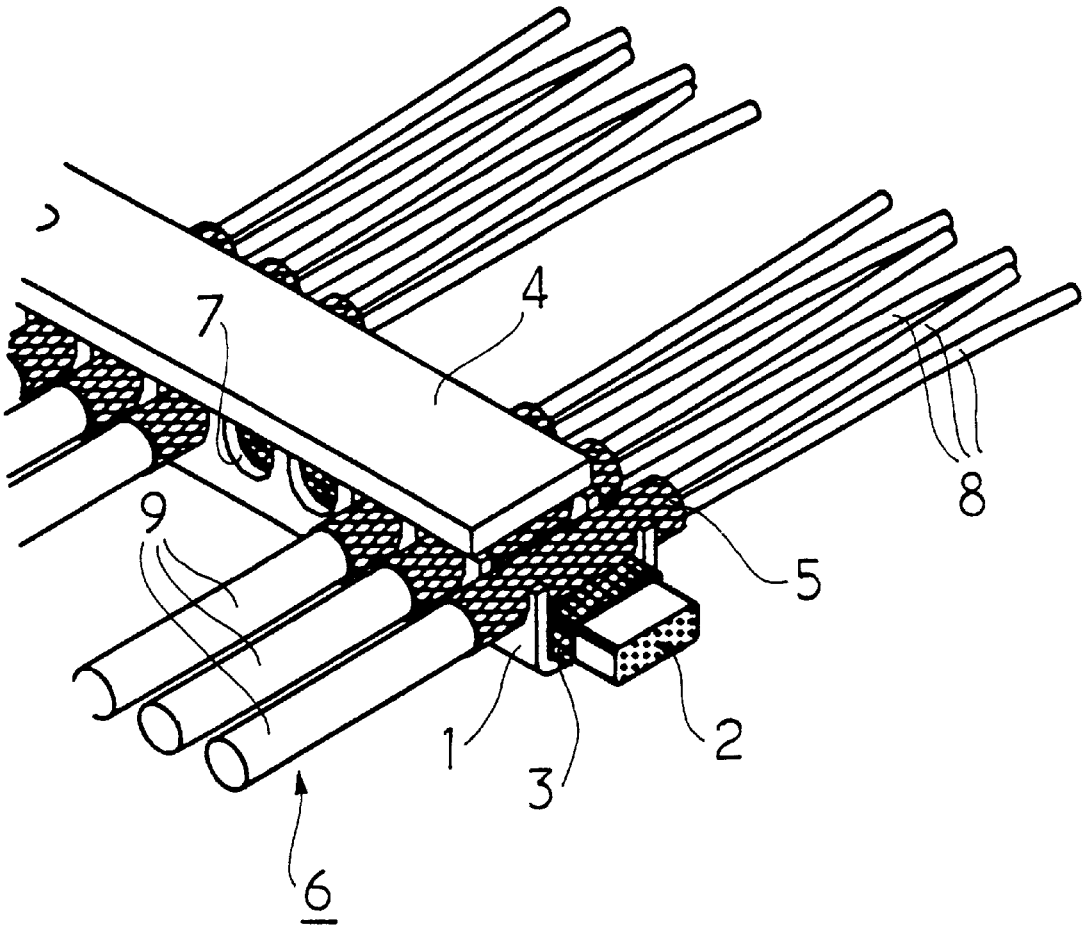
4
7
8
9
5
1
2
3
6

METHOD AND A DEVICE FOR GROUNDING THE SHIELDING BRAIDS OF SHIELDED CABLES

FIELD OF THE INVENTION

The present invention relates in general to shielded cables and to grounding the shielding braids thereof, and it relates more particularly to a method and a device for grounding the shielding braids of shielded cables.

In the present description, the term "shielding braid" is used in respect of a shielded cable to designate any shielding means implemented in a shielded cable.

BACKGROUND OF THE INVENTION

In prior art devices for grounding shielding braids of shielded cables, each shielded cable is grounded individually.

In the known prior art, shielding braids of shielded cables are grounded by respective wires, each having a terminal at its frame ground end, and soldered to the braid at its other end.

The wire is connected to the shielding by means of an automatic soldering sleeve installed on each shield that has previously been turned back onto the insulating sheath of the conductor.

In some prior art embodiments the automatic soldering sleeve is replaced by a crimpable ferrule or by a spring clip.

In another prior art embodiment, a system having spring clips on a stainless steel base serves to hold the shields of a plurality of multiconductors in place and to make electrical connections thereto.

A drawback of devices for grounding shielding braids of prior art shielded cables is that they present a high grounding impedance to the shielding braids, given their excessive length, the use of different materials, and the small cross-section of the wire connections.

OBJECTS AND SUMMARY OF THE INVENTION

An object of the invention is thus to provide a method and a device for grounding shielded cables, enabling the impedance between a grounding connection and the shielding braids of shielded cables to be reduced reliably and cheaply.

According to the invention, the device for grounding shielding braids of shielded cables comprises a longitudinal support, with a gasket covered in an electrically conductive sheath disposed in the bottom thereof, the support being suitable for receiving a cover on the top face thereof, said support including, in the upper portion thereof, a series of holes suitable for receiving the shielded cables.

According to the invention, the method of grounding shielding braids of shielded cables comprises the following steps:

- the mono-filament or multi-filament shielded cables are stripped so as to reveal the conductors and the shielding braids;
- the shielding braids of the shielded cables are turned back onto the insulating sheaths of their respective shielded cables;
- a high frequency gasket is disposed at the bottom of a support;
- the shielding braids of the shielded cables are disposed in the holes and are thus in contact with the electrically conductive sheath of the high frequency gasket; and

- a cover is fixed on the top face of the support so as to hold the shielding braids of the shielded cables in contact with the electrically conductive sheath of the high frequency gasket.

The device or method of the invention also satisfies at least one of the following characteristics:

- said electrically conductive sheath of the high frequency gasket is a meshed sheath;
- said gasket is resilient;
- said electrically conductive materials have uniform coverings;
- said electrically conductive covering materials are made of tinned copper;
- said stripped shielded cables are pressed between said cover and said electrically conductive meshed sheath of said high frequency gasket; and
- said support and said cover are made of electrically insulating material.

An advantage of the method and the device for grounding shielding braids of shielded cables of the invention is that a plurality of shielded cables can be grounded simultaneously and in very compact manner.

Another advantage of the method and the device for grounding shielding braids of shielded cables of the invention is that it can accommodate the shielding braids of cables having different diameters and compositions.

Another advantage of the method and the device for grounding shielding braids of shielded cables of the invention is a significantly lower grounding impedance, considerably improving compliance with electromagnetic compatibility (EMC) requirements.

Another advantage of the method and the device for grounding shielding braids of shielded cables of the invention is shorter implementation time.

Another advantage of the method and the device for grounding shielding braids of shielded cables of the invention is minimizing the number of individual parts.

Another advantage of the method and the device for grounding shielding braids of shielded cables of the invention lies in their suitability for application to any grounding problem, e.g. in traction equipment, or in the field of on-board computer circuits.

BRIEF DESCRIPTION OF THE DRAWING

Other objects, characteristics and advantages of the invention appear on reading the description of the preferred embodiment of the method and the device for grounding shielding braids of shielded cables, the description being made with reference to the drawing in which the sole FIGURE is a general view of a device for grounding shielding braids of shielded cables of the invention.

MORE DETAILED DESCRIPTION

The device for grounding shielding braids 5 of shielded cables 6 in the preferred embodiment shown in the sole figure comprises a longitudinal conductive support 1, of generally channel-shaped cross section, with a gasket 2 covered in electrically conductive meshed sheath 3 disposed in the bottom thereof, the conductive support 1 being suitable for receiving a conductive cover 4 on the top face thereof.

The gasket 2 covered in the electrically conductive meshed sheath 3 constitutes a high frequency gasket.

Such high frequency gaskets are, for example, sold by the JACQUES DUBOIS company under the name "joints linéaires TRICAT" [TRICAT linear gaskets].

The conductive support 1 includes, in the upper portion thereof, a series of holes 7 suitable for receiving the shielded cables 6.

According to the method of the invention, the monofilament or multi-filament shielded cables 6 are stripped so as to reveal the conductors 8 and the shielding braids 5.

The shielding braids 5 of the shielded cables 6 are preferably turned back onto the insulating sheath 9 of their respective shielded cables.

A high frequency gasket is disposed at the bottom of the conductive support 1.

The shielding braids 5 of the shielded cables 6 are disposed in the holes 7 and are thus in contact with the electrically conductive meshed sheath 3 of the high frequency gasket.

Finally, a conductive cover 4 is fixed on the top face of the conductive support 1 so as to hold the shielding braids 5 of the shielded cables 6 in contact with the electrically conductive meshed sheath 3 of the high frequency gasket.

In this embodiment, grounding the shielding braids 5 requires the electrically conductive support 1 to be grounded, for example.

In another embodiment, the support 1 and the cover 4 are made of an electrically insulating material.

In such an embodiment, grounding the shielding braids 5 requires the electrically conductive meshed sheath 3 of the high frequency gasket to be grounded.

Whatever the embodiment, the gasket 2 can have any cross-section, e.g. square, rectangular, circular, or oval.

The electrically conductive materials have uniform coverings, and are made of tinned copper, for example.

The stripped shielded cables, having shielding braids grounded according to the method of grounding shielding braids of the invention, are pressed between the cover and the gasket covered in its meshed sheath disposed in the support.

Assembly pressure is ensured by screwing the cover onto the support.

The pressure forces between the shielding braids of the stripped shielded cables and the meshed sheath of the high frequency gasket is maintained by the resilience of the high frequency gasket.

The use of a support including a series of holes has the advantage of limiting creep of the high frequency gasket.

The quality of the electrical contacts is ensured by the compatibility of the protective coverings of the conductive parts.

The device for grounding shielding braids of shielded cables is connected to the grounding of a frame by being fixed directly to the frame.

We claim:

1. A device for grounding shielding braids of shielded cables, comprising:

a longitudinal support in a shape of a trough, said longitudinal support including a plurality of holes disposed on opposite sides of said longitudinal support, said holes being dimensioned to receive said shielded cables;

a non-metal gasket covered in an electrically conductive sheath disposed in said longitudinal support; and a cover covering a top surface of said longitudinal support, wherein a shielding braid of said shielded cables is disposed between, and is abutting against, each of said electrically conductive sheath and said cover.

2. A device according to claim 1, in which said electrically conductive sheath comprises an electrically conductive meshed sheath.

3. A device according to claim 1, in which said non-metal gasket is resilient.

4. A device according to claim 1, in which said electrically conductive sheath covering said non-metal gasket circumscribes at least a portion of said shielding braid.

5. A device according to claim 1, in which said electrically conductive sheath has a uniform covering.

6. A device according to claim 1, in which said electrically conductive sheath is made of tinned copper.

7. A device according to claim 1, in which at least one stripped portion of said shielded cables is contiguously disposed between said cover of said longitudinal support and said electrically conductive sheath of said gasket.

8. A device according to claim 1, in which at least one of said longitudinal support and said cover for said longitudinal support are made of electrically insulating material.

* * * * *